US006264497B1

(12) United States Patent
Murakami et al.

(10) Patent No.: US 6,264,497 B1
(45) Date of Patent: Jul. 24, 2001

(54) INSULATOR DISPLACEMENT TYPE WATERPROOF CONNECTOR AND MANUFACTURING METHOD OF THE SAME

(75) Inventors: Takao Murakami; Masaru Fukuda, both of Shizuoka-ken (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 09/327,549

(22) Filed: Jun. 8, 1999

(30) Foreign Application Priority Data

Jun. 16, 1998 (JP) ..... 10-168852

(51) Int. Cl.[7] ..... H01R 4/24; H01R 4/26; H01R 11/20

(52) U.S. Cl. ..... 439/417; 439/752

(58) Field of Search ..... 439/417, 275, 439/404, 752

(56) References Cited

U.S. PATENT DOCUMENTS

| | | | | |
|---|---|---|---|---|
| 3,868,161 | | 2/1975 | Frantz . | |
| 4,435,034 | * | 3/1984 | Aujla et al. | 439/404 |
| 4,445,748 | * | 5/1984 | Evans | 439/271 |
| 4,978,314 | * | 12/1990 | Maejima | 439/398 |
| 5,562,478 | * | 10/1996 | Yamamoto | 439/417 |
| 5,931,699 | * | 8/1999 | Saito | 439/275 |

FOREIGN PATENT DOCUMENTS

| | | |
|---|---|---|
| 32 28 657 | 2/1984 | (DE) . |
| 93 10 650 U | 8/1993 | (DE) . |
| 2549302 | 1/1985 | (FR) . |
| 2229588 | 9/1990 | (GB) . |
| 3-81272 | 12/1991 | (JP) . |
| 5-152028 | 6/1993 | (JP) . |
| 5-152028 | 9/1993 | (JP) . |

OTHER PUBLICATIONS

European Search Report, Dec. 9, 1999.

* cited by examiner

*Primary Examiner*—Brian Sircus
*Assistant Examiner*—Hae Moon Hyeon
(74) *Attorney, Agent, or Firm*—Finnegan, Henderson, Farabow, Garrett & Dunner, L.L.P.

(57) ABSTRACT

There is provided an insulator displacement type waterproof connector for an insulated electric wire. The connector includes a terminal and a first housing which surrounds the terminal. The terminal includes an insulator displacing portion. The first housing includes a first through hole opposite to the insulator displacing portion of the terminal. The connector further includes a pressure body inserted in the first through hole of the first housing in a temporarily retained position. The pressure body is movable from the temporarily retained position to a regularly retained position to pressure contact the insulated electric wire with the insulator displacing portion. Preferably, the connector further includes an a second housing which accommodates the terminal. The second housing is fitted in the first housing. The second housing includes a second through hole opposite to the insulator displacing portion of the terminal.

17 Claims, 3 Drawing Sheets

INSULATOR DISPLACEMENT TYPE WATERPROOF CONNECTOR AND MANUFACTURING METHOD OF THE SAME

BACKGROUND OF THE INVENTION

1. Field of the Invention

This invention relates to a multipolar insulator displacement type waterproof connector which prevents an inconvenience that an insulated electric wire is in a state of non pressure-contact to an insulator displacing portion of a terminal from occurring and has excellent reliability and assemble efficiency.

2. Description of Relevant Art

This kind of an insulator displacement type water proof connector is disclosed in Japanese Patent Application Laid-open No. 5-152028, for example. The waterproof connector is composed of a waterproof plug (rubber plug) which has a plurality of electric wire through holes through which electric wires (insulated electric wires) pass, an inner housing which accommodates a plurality of terminals which are pressure contacted with the electric wires, an outer housing which accommodated the inner housing therein and is fitted to the waterproof plug in one opening portion thereof.

In case of assembling the insulator displacement type waterproof connector, the electric wires are passed through the respective electric wire through holes first. The respective electric wires are pressure contacted to a pair of insulator displacing blades of the terminals which is accommodated in respective terminal accommodating chamber of the inner housing. Therefore, the insulator displacement type waterproof connector is assembled, and a mated connector is to be fitted in and detached from other opening of the outer housing.

However, in the conventional insulator displacement type water-proof connector, in case of assembling the insulator displacement type waterproof connector, there are passed through the step of passing the electric wires through the waterproof plug, the step of pressure contacting the electric wires to the terminal, and the step of fitting the inner housing in the outer housing. Thus assembling steps of the insulator displacement type waterproof connector are complicated, and assemble efficiency is deteriorated. Further, when assembling the insulator displacement type waterproof connector, the step of pressure contacting is skipped over. If the inner housing is fitted in the outer housing in a state of non pressure-contact that the insulated electric wires are not pressure contacted to the terminals, the electric wires in the state of non pressure-contact to the terminals can not be detected. Further, the terminals are accommodated only in terminal accommodating chamber of the inner housing and there is not provided a engaging structure. Thus, reliability is lacked.

SUMMARY OF THE INVENTION

It is an object of the present invention to provide a multipolar insulator displacement type waterproof connector in which an insulated electric wire in a state of non pressure-contact is detected easily and which improves reliability and assemble efficiency.

From a first aspect of the invention, there is provided an insulator displacement type waterproof connector for an insulated electric wire. The connector comprises a terminal having an insulator displacing portion; a first housing which surrounds the terminal and has a first through hole opposite to the insulator displacing portion of the terminal; and a pressure body which is inserted in the first through hole of the first housing in a temporarily retained position and is movable from the temporarily retained position to a regularly retained position to pressure contact the insulated electric wire with the insulator displacing portion.

Preferably, the connector further comprises a second housing which is fitted in the first housing, accommodates the terminal, and has a second through hole opposite to the insulator displacing portion of the terminal.

Preferably, the connector further comprises a spacer which is interposed between the first housing and the second housing, and has a third through hole opposite to the insulator displacing portion of the terminal.

From a second aspect of the invention, there is provided a method of manufacturing an insulator displacement type waterproof connector for an insulated electrical wire. The method comprises the steps of: providing a first housing which has a first through hole; providing a terminal which has an insulator displacing portion; positioning the insulator displacing portion opposite to the first through hole; inserting a pressure body in the first through hole in a temporarily retained position where the insulated electric wire is held between the insulator displacing portion and the pressure body; and moving the pressure body to a regularly retained position, and thereby pressure contacting the insulated electric wire with the insulator displacing portion.

In the above-mentioned invention, the term "pressure contact" means that an insulator of the insulated electric wire is displaced by the insulator displacing portion of the terminal and a conductor of the insulated electric wire is contacted with the insulator displacing portion.

In the insulator displacement type waterproof connector, the insulated electric wire is arranged above the insulator displacing portion of the terminal which is accommodated in the first housing, the second housing and the spacer assembled together previously. The insulated electric wire is pressure contacted to the insulator displacing portion of the terminal by movement of the pressure body. Thus, assemble steps of the insulator displacement type waterproof connector are simplified and assemble efficiency is improved. The terminal is doubly engaged with the spacer and pressure body, and reliability is improved. Further, whether the insulated electric wire has already been pressures contacted or has not yet been is easily detected by movement amount of the pressure body, and thus the inconvenience that the insulated electric wire is in the state of non pressure-contact is prevented from occurring.

BRIEF DESCRIPTION OF THE ACCOMPANYING DRAWINGS

DETAILED DESCRIPTION OF THE PREFERRED EMBODIMENTS

An embodiment of the present invention will now be explained with reference to the drawings.

Figure 1:
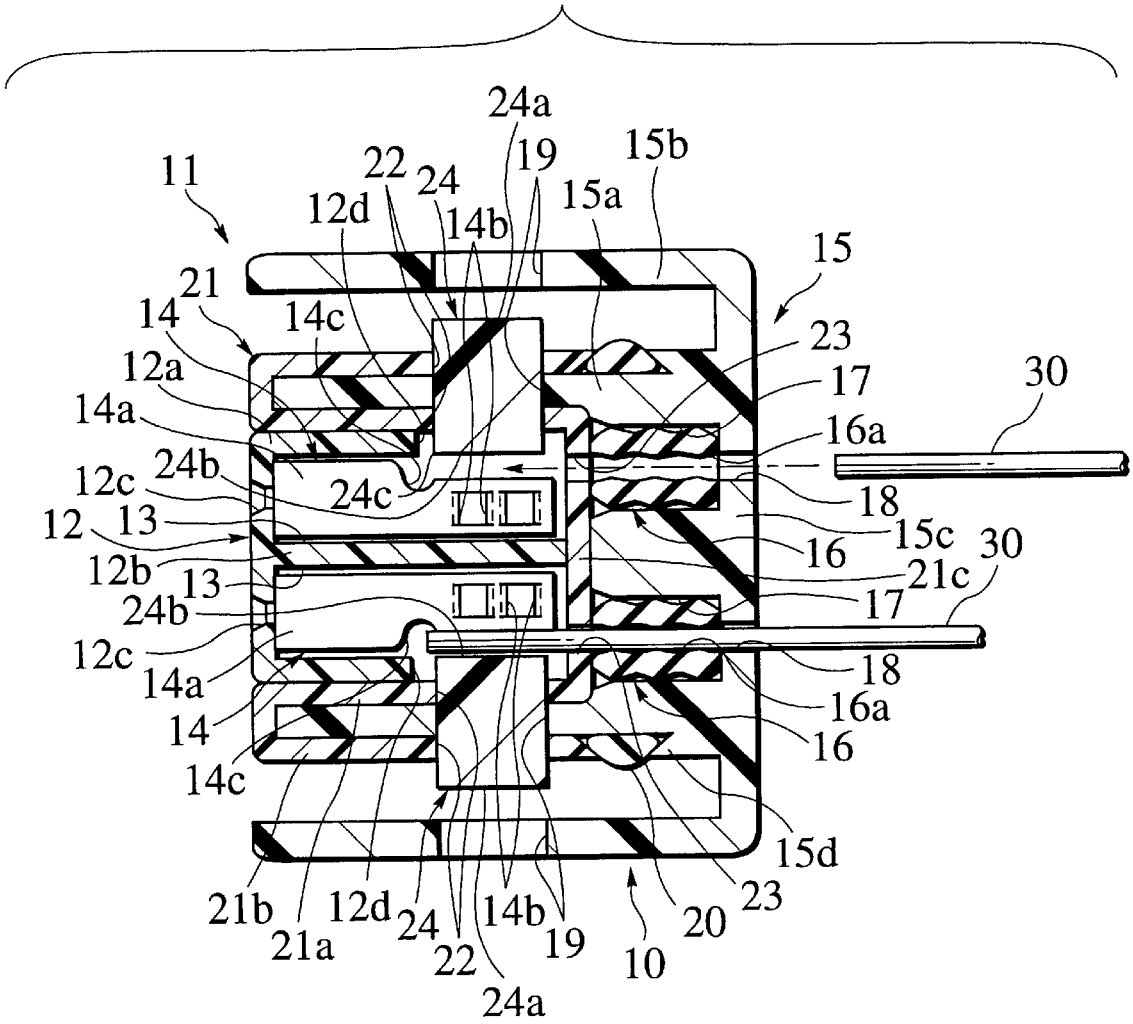
FIG. 1 is a cross-sectional view of an insulator displacement type waterproof connector according to an embodiment of the present invention before insulated electrical wires thereof are pressure contacted.
Figure 2:
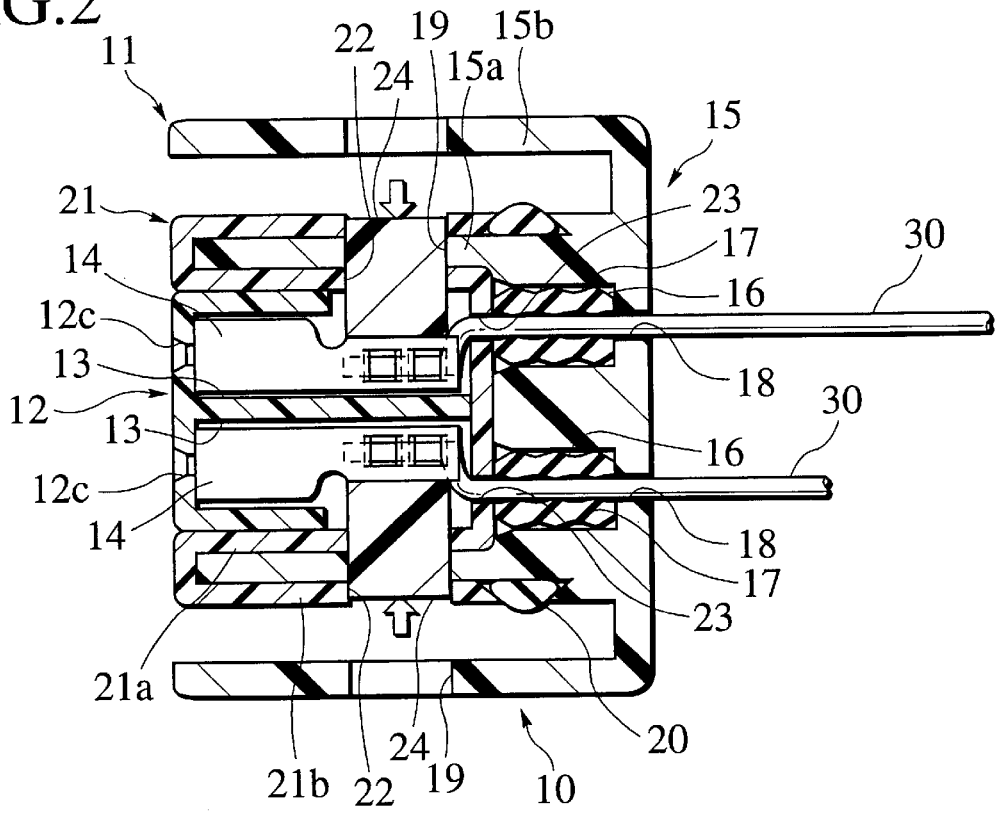
FIG. 2 is a cross-sectional view of the insulator displacement type waterproof connector in which the insulated electric wires are in a state of pressure-contact.
Figure 3:
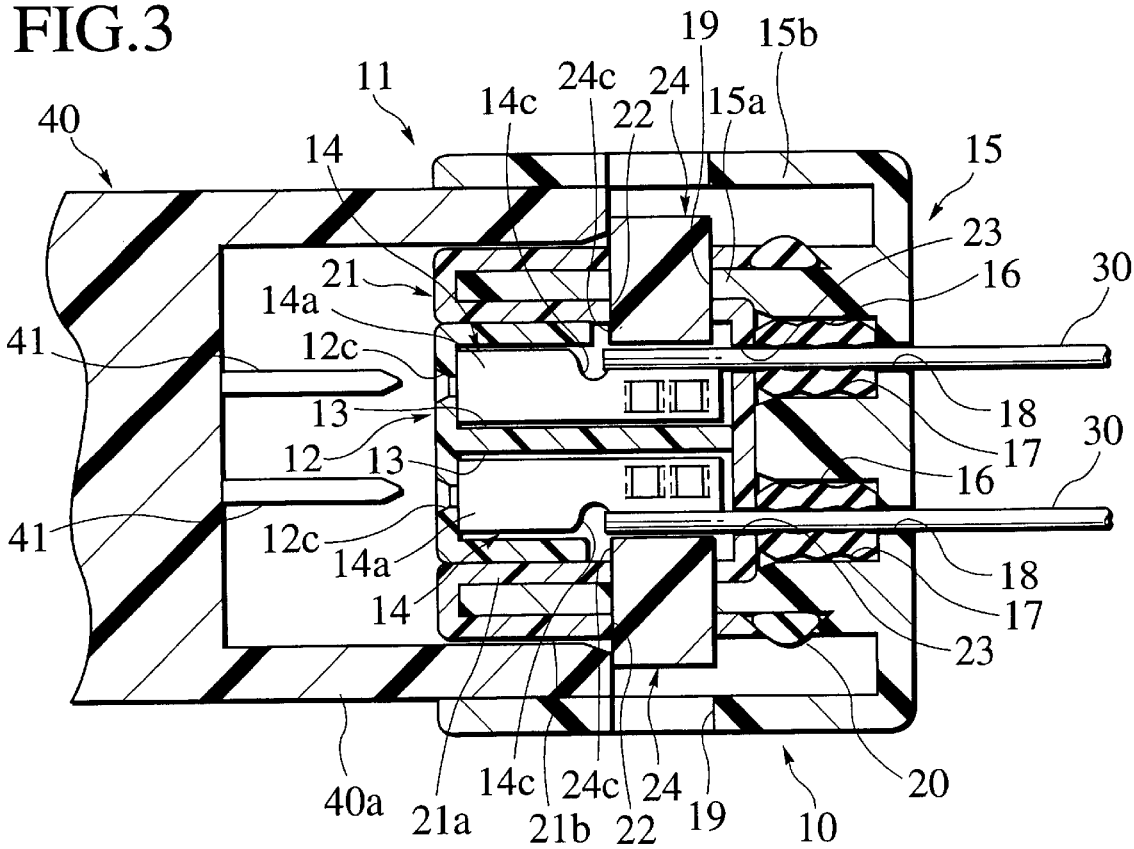
FIG. 3 is a cross-sectional view of the insulator displacement type waterproof connector in which insulated electric wires are in a state of non pressure-contact.

As illustrated in FIGS. 1 to 3, a connector housing 11 of an insulator displacement type waterproof connector 10 is constructed of a synthetic resin-made inner housing 12, or a second housing, having a plurality of terminal accommodation chambers 13 formed integrally therewith, a synthetic resin-made outer housing 15, or a first housing, having this inner housing 12 fitted thereinto, and a synthetic resin-made spacer 21 interposed between the inner housing 12 and the outer housing 15 and having retained thereby female type insulator displacement type terminals 14 that have been accommodated in their corresponding terminal accommodation chambers 13 of the inner housing 12.

The inner housing 12 as a second housing has a box portion 12*a* the upper and lower surfaces of which are open on their rear sides thereof, and the respective terminal accommodation chambers 13 are formed in the spaces that are formed between a central horizontal wall 12*b* and upper and lower vertical side walls not illustrated concurrently serving as partitioning walls. The terminals 14 are accommodated within these respective terminal accommodation chambers 13. Further, at the positions, opposing the respective terminal accommodation chambers 13, of the box portion 12*a* of the inner housing 12, there are formed rectangular insertion through holes 12*c* through which male terminals 41 within a hood portion 40*a* of a mated side connector 40 illustrated in FIG. 3 are passed. Further, a pair of upper and lower opening portions 12*d* that are on a rear side of the box portion 12*a* of the inner housing 12 form through-holes for permitting insertion therethrough of a pressure body.

In each of both sides plate portions of a rear portion of the box portion 14*a* of the female type terminal 14 there are formed a pair of insulator displacing blades 14*b*, 14*b*, or insulator displacing portions, by the side plate portions being bent. The insulator displacing blades 14*b*, 14*b* each have a blade and a slot portion shown in FIG. 4A.

The outer housing 15 as a first housing is constituted by a substantially square-cylindrical inner wall portion 15*a*, a substantially square-cylindrical outer wall portion 15*b* that surrounds the inner wall portion 15*a*, and a bottom wall portion (a wall portion) 15*c* that connects together rear portions of the inner and outer wall portions 15*a* and 15*b* and is thereby made into a double-walled box which is open on its frontal surface side. The bottom wall portion 15*c* is thick-walled at the center. At the positions, opposing the respective terminal accommodation chambers 13, on the frontal side of the thick-walled portion there are respectively formed large-in-diameter and circular-in-section rubber plug accommodation recessed portions 17 into which waterproof rubber plugs 16 are accommodated by forced insertion or the like. On the other hand, in a rear side part of the thick-walled portion there are respectively formed small-in-diameter and circular-in-section electric wire insertion through holes 18 through which insulated electric wires 30 are passed so that these insertion through holes 18 may communicate with their corresponding rubber plug accommodation recessed portions 17. It is to be noted that the waterproof rubber plug 16 is made into a substantially circular-cylindrical body whose inner and outer peripheral surfaces are each in the form of concavities and convexities. Further, the rubber plug 16 has an electric wire through-hole 16*a* through which the insulated electric wire 30 is internally passed.

Also, at the positions, opposing a pair of the insulator displacing blades 14*b*, 14*b* of the terminal 14 accommodated in each terminal accommodation chamber 13 of the inner housing 12, of the corresponding inner and outer wall portions 15*a*, 15*b* of the outer housing 15, there are respectively formed rectangular through-holes 19 for insertion of a pressure body. Further, at a large-depth portion on an outer surface side of the inner wall portion 15*a* of the outer housing 15, there is integrally protectively formed a V-shaped packing reception portion 15*d* for receiving therein an annular rubber-made waterproof packing 20.

The spacer 21 is constituted by a substantially square-cylindrical trunk portion 21*a* that is fitted into the inner wall portion 15*a* of the outer housing 15, a substantially square-cylindrical flange portion 21*b* that is integrally so formed as to be bent rearward from a frontal end of the trunk portion 21*a* and that is fitted onto an outer surface side of the inner wall portion 15*a* of the outer housing 15, and a bottom wall portion (a wall portion) 21*c* of the trunk portion 21*a*. The spacer 21 is thereby made into a box whose frontal surface side is open.

And, it is arranged that the box portion 12*a* of the inner housing 12 is fitted into the interior of the trunk portion 21*a* of the spacer 21. On the inner surfaces of upper and lower walls of the trunk portion 21*a* of the spacer 21 there are formed respectively integrally therewith rib-like and terminal draw-off preventing projections not illustrated that respectively retain by engagement rear end edge of the box portion 12*a* of the inner housing 12 and rear end edges 14*c* of the box portion 14*a* of the terminals 14 accommodated in the respective terminal accommodation chambers 13. At the positions, opposing the insulator displacing blades 14*b* of the terminal 14 accommodated in each of the terminal accommodation chambers 13 of the inner housing 12, of the trunk portion 21*a* and flange portion 21*b* of the spacer 21, there are respectively formed rectangular through holes 22 for insertion thereinto of the pressure body. Further, a forward end portion of the flange portion 21*b* of the spacer 21 is arranged to retain the packing 20 that has been retained by engagement in the packing reception portion 15*d* of the inner wall portion 15*a* of the outer housing 15 when the fitting of the spacer 21 into the outer housing 15 has been completed.

Also, electric wire insertion through holes 23 are respectively formed at the positions, opposing the respective electric wire insertion through holes 18 of the outer housing 15, of the bottom wall portion 21*c* of the spacer 21. Further, the bottom wall portion 21*c* of the spacer 21 is arranged to retain the rubber plugs 16 that have been inserted in the respective rubber plug accommodation recessed portions 17 of the bottom wall portion 15*c* of the outer housing 15 when the fitting into the outer housing 15 has been completed so that the rubber plugs can be freely drawn off or prevented from being drawn off.

Further, into the respective pressure body insertion through-holes 19 of the outer housing 15, respective pressure body insertion through-holes 22 of the spacer 21 and respective opening portions 12*d* serving as the pressure body insertion through-holes of the inner housing 12, there are slidably fitted synthetic resin-made block-like pressure bodies 24 that are used to make pressure-contact of the insulated electric wires 30 to their respective pairs of insulator displacing blades 14*b*, 14*b* of the respective terminals 14. Namely, the insulated electric wires 30 pass respectively through the electric wire insertion through holes 18 of the outer housing 15, electric wire insertion through holes 16*a* of the rubber plugs 16 and electric wire insertion through holes 22 of the spacer 21 and are located over their respective pairs of insulator displacing blades 14*b*, 14*b* of the terminals 14. The insulated electric wires 30 are displaced and contacted to their respective pairs of insulator displacing blades 14*b*, 14*b* of the terminals 14 by the pressure bodies 24 being by-pressure moved by pressing members not illustrated or the like from their temporarily retained positions illustrated in FIG. 1 inside the through holes 19, 22 and opening portions 12*d* to their regularly retained positions illustrated in FIG. 2. In the temporarily retained position, an upper surface 24*a* of the pressure body 24 is protruded upward from the flange portion 21*b* of the spacer 21. In the regularly retained position, the upper surface 24*a* of the pressure body 24 is located at a level that is lower than the flange portion 21*b* of the spacer 21. Further, the state of engagement between the outer housing 15 and the spacer 21 is fixedly retained by the pressure body 24 located at the regularly retained position. In this retained position, the terminal 14 is fixedly retained using a corner portion 24*c* on the underside 24*b* side of the pressure body 24 and the rear end edge 14*c* of the box portion 14*a* of the terminal 14.

In a case where assembling the insulator displacement type waterproof connector 10 of this embodiment, the following procedures are taken beforehand. Namely, the rubber plugs 16 are respectively inserted into, and set in, from the direction in which the connector housing is fitted, the respective rubber plug accommodation recessed portions 17 located inside the bottom wall portion 15*c* of the outer housing 15 constituting the outer side of the connector housing 11. Then, the packing 20 is inserted into, and set in, the packing reception portion 15*d* of the inner wall portion 15*a* of the outer housing 15. In this state, the trunk portion 21*a* of the spacer 21 is fitted onto the inner wall portion 15*a* of the outer housing 15 and then the inner housing 12 is fitted into the trunk portion 21*a* of the spacer 21. Then, the respective pressure bodies 24 are fitted into the pressure body insertion through holes 19, 22 of the outer housing 15 and spacer 21 and respective opening portions 12*d* of the inner housing 12 and are thereby kept in their provisionally retained states.

Next, as illustrated in FIG. 1, the insulated electric wires 30 are respectively passed, from the outside, through their corresponding electric wire insertion through holes 16*a*, 23 of the respective rubber plugs 16 and bottom wall portion 21*c* of the spacer 21 via their corresponding electric wire insertion through holes 18 of the bottom wall portion 15*c* of the outer housing 15. As a result, the insulated electric wires 30 are thereby located at a level that is over their corresponding pairs of insulator displacing blades 14*b*, 14*b* of the terminals 14. Next, as illustrated in FIG. 2, the respective pressure bodies 24 are press moved by the pressing member not illustrated or the like from their provisionally retained positions to their regularly retained positions, respectively, thereby causing the respective insulated electric wires 30 to be pressure contacted to their corresponding pairs of insulator displacing blades 14*b*, 14*b* of the terminals 14. By such regular retentions of the respective pressure bodies 24, the state of engagement between the outer housing 15 and the spacer 21 is fixedly maintained at its relevant portions. Also, at this fixed maintenance time, engaging pawls not illustrated of the box portion 12*a* of the inner housing 12 are engaged with engaging holes not illustrated of the inner wall portion 15*a* of the outer housing 15. Further, the terminals 14 are doubly retained by the rib-like and terminal draw-off preventing projections not illustrated of the inner surfaces of the upper and lower walls of the trunk portion 21*a* of the spacer 21 and the corner portions 24*c* of the underside 24*b* sides of the pressure bodies 24. The assembling of the insulator displacement type waterproof connector 10 is thus completed.

In this way, it is possible to dispose respectively the insulated electric wires 30 over their corresponding pairs of insulator displacing blades 14*b*, 14*b* of the terminals 14 accommodated in the respective terminal accommodation chambers 13 of the inner housing in the assembly of the previously assembled outer housing 15, spacer 21 and inner housing 12, thereby easily performing pressure-contact of the respective insulated electric wires 30 to their corresponding pairs of blades 14*b*, 14*b* of the respective terminals 14 by depressing their corresponding pressure bodies 24 downwardly. This makes it possible to simplify the assembling process of the insulator displacement type waterproof connector 10 into an electric wire passing-through step and electric wire pressure-contact step and this makes it possible to enhance the assembling efficiency. Further, since the respective terminals 14 are each doubly retained by the spacer 21 and pressure body 24, it is possible to enhance the reliability involved.

Figure 4A:
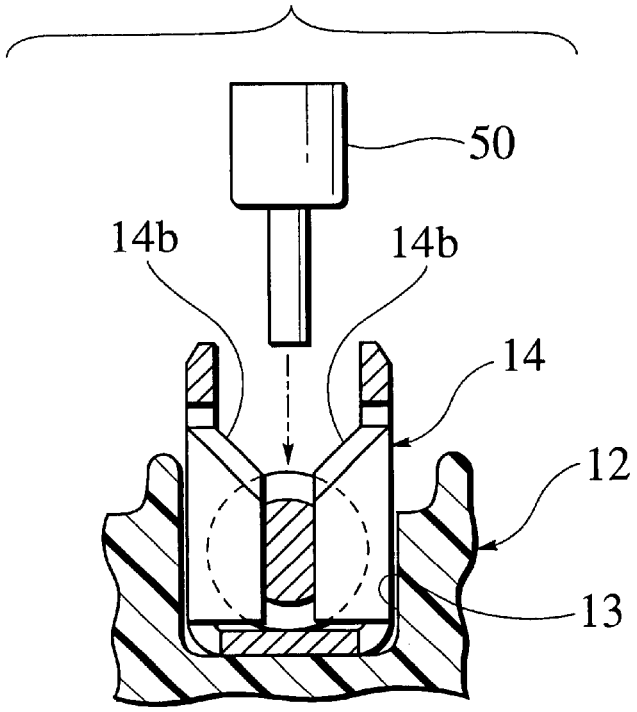
FIG. 4A is an explanation view of a state before a state of pressure contacting the insulated electric wires of the insulator displacement type waterproof connector is measured by a measuring gage.
Figure 4B:
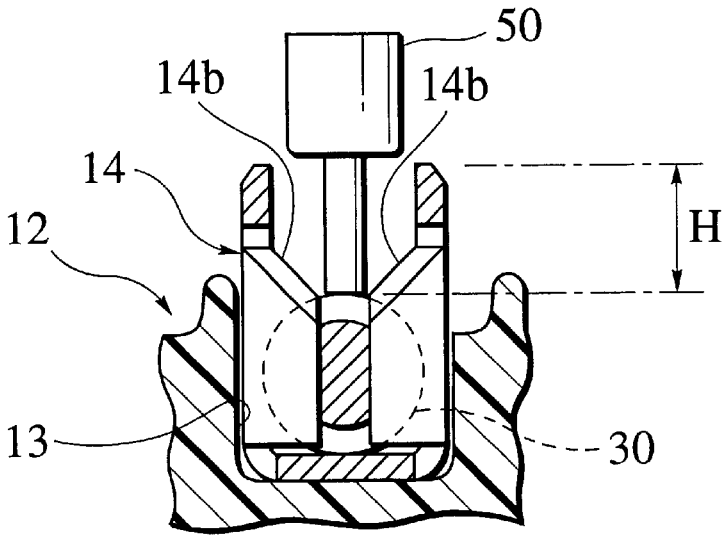
FIG. 4B is an explanation view of a state that a state of pressure contacting the insulated electric wires is measured by the measuring gage which has depressed.

Also, when assembling the insulator displacement type waterproof connector 10, the following merit exists in a case where an assembling operator has forgotten the execution of the pressure-contact step for causing the insulated electric wires 30 to be pressure contacted to their corresponding pairs of insulator displacing blades 14*b*, 14*b*. Namely, since as illustrated in FIG. 3 the pressure bodies 24 are kept located at their provisionally retained positions and kept not depressed, a mated side connector 40 cannot be fitted to the insulator displacement type waterproof connector 10. Therefore, it is possible to easily detect that the pressure-contact step has been skipped over. In this way, whether the insulated electric wires 30 have already been pressure contacted or have not yet been so done can be easily detected according to whether or not the respective pressure bodies 24 have been depressed. However, this detection is easily managed by measuring the amount of fall H of a measuring gage 50 as illustrated in FIGS. 4A and 4B, whereby the inconvenience that the insulated electric wires 30 are in the state of non pressure-contact is reliably prevented from occurring. Therefore, it is possible to provide a high quality of insulator displacement type waterproof connector 10 at a low cost.

Further, the respective rubber plugs 16 are prevented from being drawn off by the bottom wall portion 15*c* of the outer housing 15 and are thereby reliably prevented from falling away from the connector assembly. Also, the packing 20 is prevented from being drawn off by the oblique forward end of the flange portion 21*b* of the spacer 21. For these reasons, the respective terminal accommodation chambers 13 of the inner housing 12 and the respective insulated electric wires 30 are reliably sealed by the respective rubber plugs 16 and packing 20 and therefore the waterproofness of the connector housing is enhanced again.

What is claimed is:

1. An insulator displacement type waterproof connector for an insulated electric wire, comprising:

a terminal having an insulator displacing portion;

a first housing surrounding the terminal, the first housing having a first through hole opposite to the insulator displacing portion of the terminal and an electric wire insertion hole configured to accept the insulated electrical wire therethrough and position the insulated electrical wire between the first through hole and the insulator displacing portion of the terminal;

a second housing fitted in the first housing, the second housing accommodating the terminal, the second housing having a second hole opposite to the insulator displacing portion of the terminal; and a pressure body inserted in the first through hole of the first housing in a temporarily retained position, the pressure body movable from the temporarily retained position to a regularly retained position to pressure contact the insulated electric wire with the insulator displacing portion.

2. The insulator displacement type water proof connector according to claim 1, further comprising:

a spacer interposed between the first housing and the second housing, the spacer having a third through hole opposite to the insulator displacing portion of the terminal.

3. The insulator displacement type water proof connector according to claim 2, wherein the pressure body is inserted in the second through hole of the second housing and the third through hole of the spacer.

4. The insulator displacement type water proof connector according to claim 3, wherein the pressure body protrudes out of the third through hole away from the terminal when the pressure body is in the temporarily retained position.

5. The insulator displacement type water proof connector according to claim 4, wherein the pressure body is retained within the third hole when the pressure body is in the regularly retained position.

6. The insulator displacement type water proof connector according to claim 2, further comprising a rubber plug disposed between the first housing and the spacer.

7. The insulator displacement type water proof connector according to claim 6, wherein the rubber plug is disposed in a rubber plug accommodation recessed portion of the first housing.

8. The insulator displacement type water proof connector according to claim 7, wherein the rubber plug includes an electric wire insertion hole configured to accept the insulated electric wire therethrough.

9. The insulator displacement type water proof connector according to claim 8, wherein the spacer includes an electric wire insertion hole configured to accept the insulated electric wire therethrough.

10. A method of assembling an insulator displacement type waterproof connector for an insulated electrical wire, comprising the steps of:

providing a first housing having a first through hole;

providing a second housing having a second through hole;

providing a terminal having an insulator displacing portion;

accommodating the terminal in the second housing;

fitting the second housing into the first housing;

positioning the insulator displacing portion opposite to the first through hole;

inserting a pressure body in the first through hole and in the second through hole in a temporarily retained position;

positioning the insulated electric wire between the insulator displacing portion and the pressure body; and moving the pressure body to a regularly retained position, and thereby pressure contacting the insulated electric wire with the insulator displacing portion.

11. The method of claim 10, further comprising the steps of:

providing a spacer having a third through hole;

interposing the spacer between the first housing and the second housing; and inserting the pressure body in the third through hole.

12. The method of claim 11, wherein the pressure body protrudes out of the third through hole away from the terminal when the pressure body is in the temporarily retained position.

13. The method of claim 12, wherein the pressure body is retained within the third hole when the pressure body is in the regularly retained position.

14. The method of claim 11, further comprising the step of inserting a rubber plug between the first housing and the spacer.

15. The method of claim 14, wherein the rubber plug is inserted in a rubber plug accommodation recessed portion of the first housing.

16. The method of claim 15, further comprising the step of inserting the insulated electric wire through an electric wire insertion hole formed in the rubber plug.

17. The method of claim 16, further comprising the steps of:

inserting the insulated electric wire through an electric wire insertion hole formed in the first housing; and inserting the insulated electric wire through an electric wire insertion hole formed in the spacer.

* * * * *